United States Patent [19]

Yasuda et al.

[11] Patent Number: 4,714,804

[45] Date of Patent: Dec. 22, 1987

[54] ROTARY SWITCH HAVING ROTARY CONTACTS WITH AN AMORPHOUS ALLOY COATING

[75] Inventors: Keiji Yasuda, Handa; Yukihisa Oda, Chiryu; Shigemitsu Hamajima, Oobu; Masami Ishii, Toyota; Katsumi Nakanishi, Nagoya; Takayoshi Tsuzuki, Toyota; Jyou Tsuda, Ama, all of Japan

[73] Assignee: Aisin Seiki Kabushikikaisha, Aichi, Japan

[21] Appl. No.: 827,585

[22] Filed: Feb. 10, 1986

[30] Foreign Application Priority Data

Feb. 8, 1985 [JP] Japan ..... 60-023972

[51] Int. Cl.[4] ..... H01H 1/02; H01H 19/08; H01H 21/12

[52] U.S. Cl. ..... 200/11 DA; 200/267; 200/292

[58] Field of Search ..... 200/11 D, 11 DA, 262–268, 200/292; 340/347 P

[56] References Cited

U.S. PATENT DOCUMENTS

| | | | |
|---|---|---|---|
| 3,017,532 | 1/1962 | Talmey | 200/267 X |
| 3,293,399 | 12/1966 | Heinrich | 200/267 X |
| 4,345,240 | 8/1982 | Amano et al. | 340/347 P X |

FOREIGN PATENT DOCUMENTS

| | | |
|---|---|---|
| 1302192 | 2/1962 | Fed. Rep. of Germany . |
| 3039993 | 6/1982 | Fed. Rep. of Germany . |
| 1222969 | 2/1971 | United Kingdom . |

OTHER PUBLICATIONS

Von H. Wiegand et al., "Eigenschaften chemischer Nickelniederschlage aus dem Hypophosphitbad", Metalloberflache, 22 Jg. 1968, Heft 10, pp. 304–305.

*Primary Examiner*—J. R. Scott

*Attorney, Agent, or Firm*—Sughrue, Mion, Zinn, Macpeak & Seas

[57] ABSTRACT

Rotary electrical signal generator includes fixed electric contacts and slider contacts which engage the fixed contacts. To enhance the abrasion resistance and the corrosion resistance, the surface of printed electrodes is coated with an amorphous Ni-P plated layer containing from 15 to 25 atom % of P.

5 Claims, 6 Drawing Figures

ROTARY SWITCH HAVING ROTARY CONTACTS WITH AN AMORPHOUS ALLOY COATING

BACKGROUND OF THE INVENTION

The invention relates to an electric contactor device including fixed electric contacts and a movable electric contact which is disposed for abutment against the fixed contacts. In particular, while not limited thereto, the invention relates to an electric signal generator including fixed electric contacts formed on a printed circuit board and an electric slider contact carried by a rotor and disposed for abutment against the fixed electric contacts.

Such an electric signal generator may be utilized as a throttle opening sensor which is connected to a throttle valve of an engine, one example of which is disclosed in U.S. Pat. No. 4,345,240 issued to Hiroyuki Amano et al. The throttle opening sensor includes a plurality of split electrodes formed on a printed electrical circuit board and an electrically conductive slider having a plurality of radially extending legs which fixedly carry contact members disposed for contact with the plurality of split electrodes. The electrically conductive slider is secured to a shaft which is in turn fixedly mounted on the rotatable shaft of a throttle valve. The potential of the slider is maintained at a ground potential while the split electrodes assume the ground potential only when they are engaged by contact members on the slider. In this manner, the output is in the form of a bi-level signal, and the combination of outputs from the split electrodes constitute together a code corresponding to the opening of the throttle valve.

Generally, the throttle opening sensor is mounted on an engine or is disposed very close to the engine, and thus is subject to heat radiation therefrom to raise its temperature. The plurality of split electrodes formed on a printed electrical circuit board comprises a conductor on the circuit board formed by a copper foil, which is then plated with nickel, and the nickel plating is in turn plated with gold or palladium. The nickel plating has a relatively high level of abrasion resistance but exhibits a relatively low level of corrosion resistance and a relatively high contact resistance, which is the reason to provide the gold or palladium plating or coating thereon. As is well recognized, a gold plating exhibits an increased corrosion resistance and a reduced contact resistance, but since it has a low level of abration resistance, it is applied as a relatively thick coating. Because both gold and palladium are relatively expensive, the described throttle opening sensor requires an increased cost for the materials.

SUMMARY OF THE INVENTION

It is a first object of the invention to increase the corrosion resistance and the abrasion resistance of fixed electric contacts and a movable electric contact, which is disposed for abutment against the fixed contacts, of an electric contactor device which may be used in a throttle opening sensor. A second object is to reduce the cost required for the materials.

The above objects are achieved in accordance with the invention by coating the surface of the electric contacts, including both the fixed and the movable contacts, with an amorphous plating containing abrasion resistant conductor metal element. In a preferred embodiment of the invention, the surface is coated with nickel-phosphorus amorphous plating. Grain boundaries are reduced or substantially absent in an amorphous plating containing conductor metal element, and thus stand in the way to the growth of a corrosion process, whereby the amorphous plating exhibits an increased corrosion resistance. Since the plating essentially comprises nickel, it exhibits a high abrasion resistance and can be inexpensively applied.

Other objects and features of the invention will become apparent from the following description of an embodiment thereof with reference to the drawings.

DESCRIPTION OF PREFERRED EMBODIMENT

Figure 1:
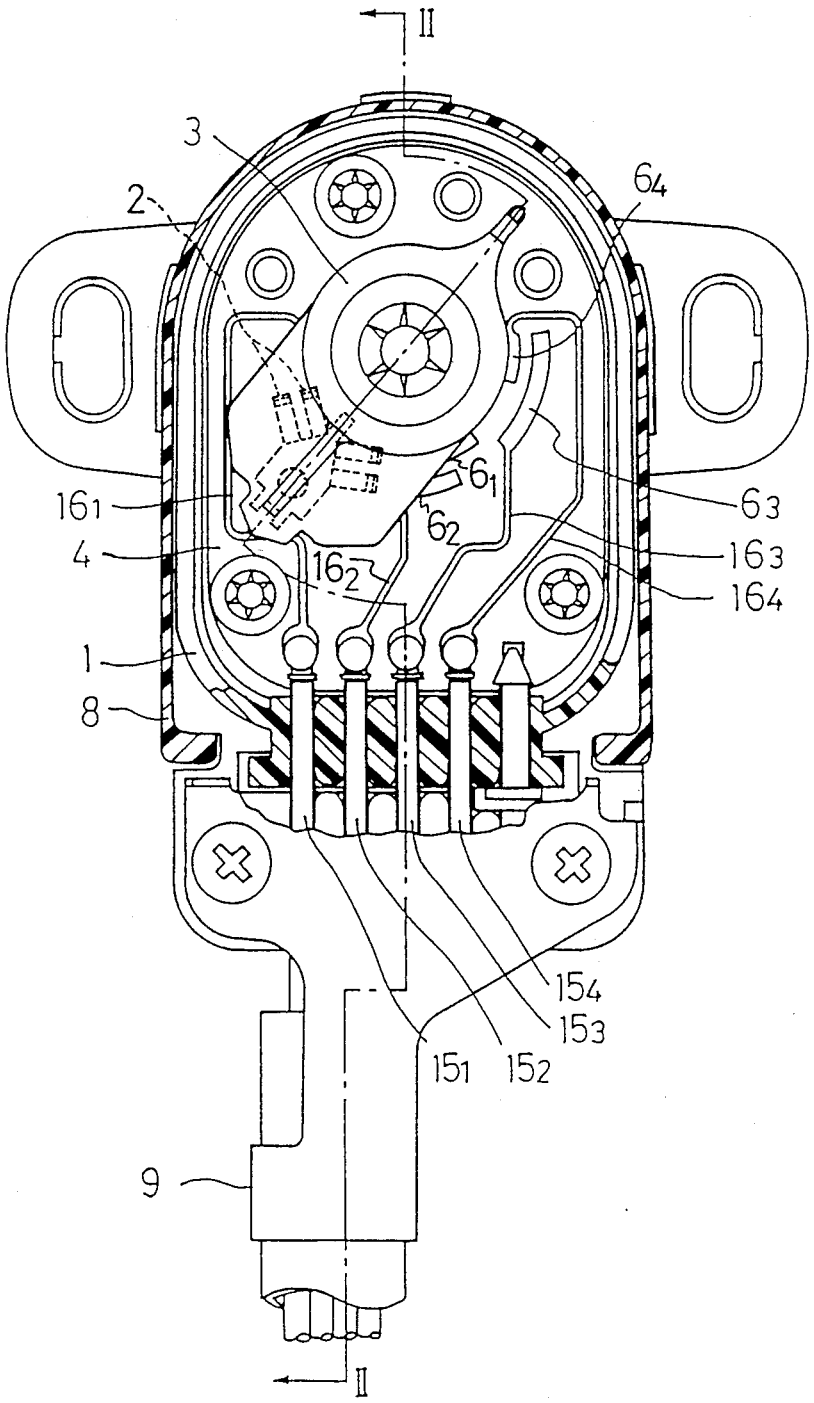
FIG. 1 is a plan view, partly broken away, of a preferred embodiment of the invention.
Figure 2:
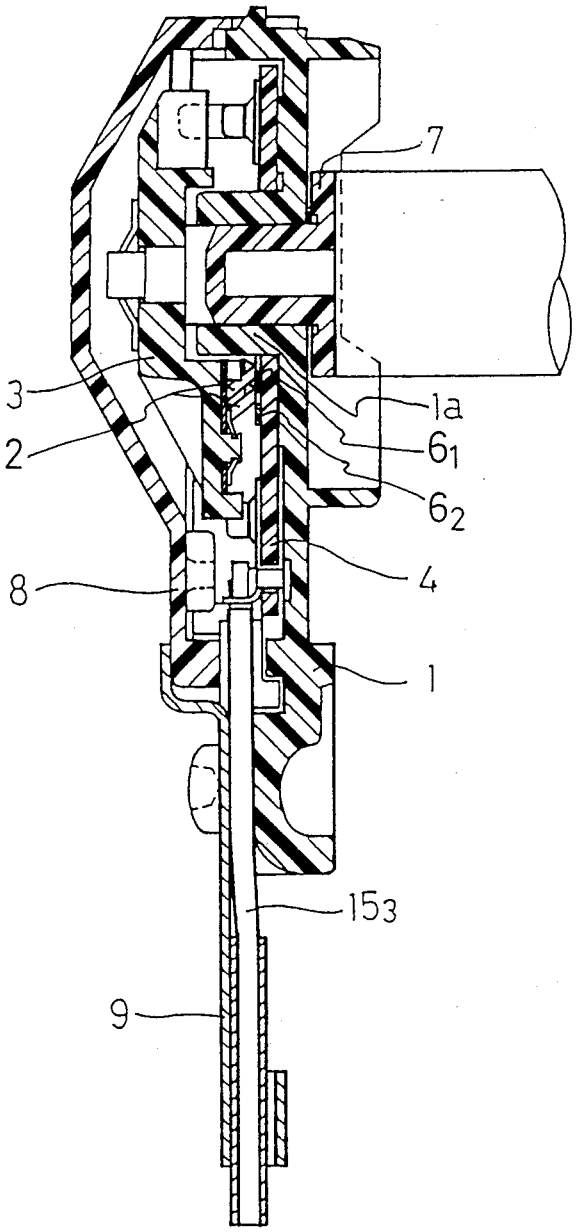
FIG. 2 is a cross section taken along the line II—II shown in FIG. 1.

Referring to FIGS. 1 and 2, which illustrate a throttle opening sensor according to a preferred embodiment of the invention, there is shown a base 1 in which an annular boss 1*a* is formed. The boss 1*a* is formed with a bore through which a rotatable shaft 7 extends. A printed circuit board 4 is secured to the internal surface of the base 1, and fixedly carries a plurality of split electrodes 6 ($6_1$, $6_2$, $6_3$, $6_4$) and their connected printed electrode leads 16 ($16_1$ to $16_4$). At its one end, the rotatable shaft 7 fixedly carries a rotatable arm 3 while its other end is coupled to a rotating shaft of a throttle valve, not shown.

Figure 3A:
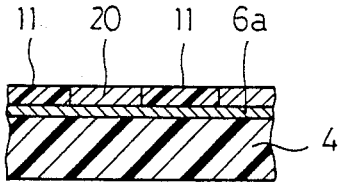
FIG. 3*a* is an enlarged cross section of part of a printed circuit board shown in FIG. 1 during a masking step.
Figure 3B:
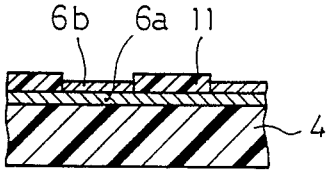
FIG. 3*b* is an enlarged cross section of part of the printed circuit board shown in FIG. 1 during a plating step.
Figure 3C:
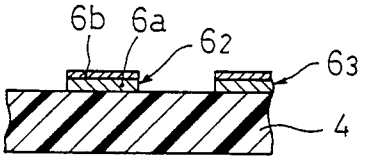
FIG. 3*c* is an enlarged cross section of part of the printed circuit board shown in FIG. 1.
Figure 4:
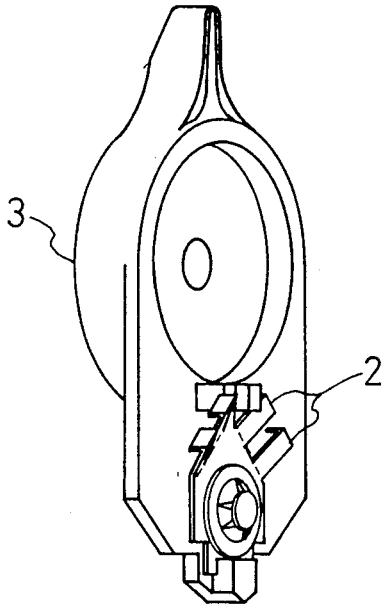
FIG. 4 is a perspective view of the rotatable arm and the contacts carried thereby.

Split electrodes $6_2$, $6_3$ on the printed circuit board 4 are shown in an enlarged cross section of FIG. 3*c*. It is to be noted that each of the split electrodes 6 comprises a layer of copper foil 6*a* which is contiguous with an associated printed electrode lead 16, and an amorphous nickel-phosphorus plated layer 6*b* which covers the surface of the layer 6*a*.

The rotatable arm 3 has secured thereto an electrically conductive slider having a plurality of radially extending legs 2 which fixedly carry contact members disposed for contact with the plurality of split electrodes 6, the legs 2 being disposed so as to be located opposite to the plane of the circuit board 4.

The ends of the printed electrode leads 16 are connected to lead wires 15 ($15_1$ to $15_4$). At any point within a predetermined range of angle of rotation for the rotatable shaft 7, a given one of the plurality of the legs is maintained in contact with a given one, $6_1$, of the plurality of split electrode 6. As mentioned previously, the split electrode $6_1$ is contiguous with the printed electrode lead $16_1$ which is connected to the lead wire $15_1$, to which the ground potential or a constant positive potential is applied. Accordingly, the ground potential or the constant positive potential is applied to all of the legs 2. The ground potential or the positive potential is applied to any of the remaining split electrodes ($6_2$, $6_3$, . . . ) only when it is engaged by the leg 2, and a combination of potentials on the lead wires $15_2$, $15_3$ and $15_4$ represents a throttle opening.

A casing 8 is fixedly connected to the base 1 so that the combination of the casing 8 and the base 1 encloses a space in which the printed circuit board 4 and the rotatable arm 3 are received. The lead wires 15 are secured to a lead wire support member 9 which is secured to the base 1.

Referring to FIGS. 3*a*, 3*b* and 3*c*, a method of manufacturing the split electrodes 6 will be described. Initially referring to FIG. 3*a*, the printed circuit board 4 comprises a board of synthetic resin such as epoxy resin, on the surface of which is bonded the copper foil 6*a*. A screen printing plate 20 having openings formed therein except for the locations of the split electrodes 6 and their contiguous printed electrode leads 16 is placed on top of the surface of the copper foil 6*a*. Synthetic resin 11, which serves as a mask or a plating resist subsequently, is then screen printed onto the copper foil 6*a* through the plate 20.

As shown in FIG. 3*b*, an amorphous nickel-phosphorus layer 6*b* is applied to the copper foil 6*a* on the printed circuit board 4 in regions where it is exposed, by employing an amorphous plating process. The synthetic resin 11 is then removed, and an etching process is used to remove the copper foil 6*a* in regions where it has previously been masked by the synthetic resin 11, as shown in FIG. 3*c*.

The amorphous plating process described above employs an electroless plating bath disclosed in pending U.S. patent application Ser. No. 736,859 filed May 23, 1985, now U.S. Pat. No. 4,636,255, by Jho Tsuda and assigned to the assignee of the present application. The electroless plating bath is an aqueous solution comprising nickel ions, a nickel ion reducing agent, a pH adjuster, a pH buffer, a nickel ion sequestering agent, a reduced amount of stress reducing agent and phosphorus deposition promoter. The phosphorus deposition promoter includes a first and a second promoter. The first phosphorus deposition promoter comprises trisodium N-(2-hydroxyethyl)ethylenediamine-N,N',N'-triacetate ($C_{10}H_{15}N_2Na_3O_7$).

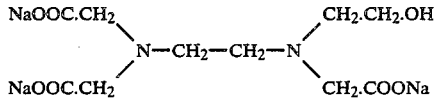

The second phosphorus deposition promoter comprises one or more salts chosen from sulfates such as ammonium sulfate, lithium sulfate, potassium sulfate, sodium sulfate or the like. The first phosphorus deposition promoter may be employed alone, or the first and the second phosphorus deposition promoter may be used in combination. However, the second phosphorus deposition promoter cannot be used alone. The second phosphorus deposition promoter is effective only when it is used in combination with the first phosphorus deposition promoter.

The electroless plating bath including at least the first phosphorus deposition promoter enables the deposition of phosphorus to a medium level by adjusting the amount of the first phosphorus deposition promoter added. Trisodium N-(2-hydroxyethyl)-ethylenediamine-N,N',N'-triacetate $C_{10}H_{15}N_2Na_3O_7$) has a high sequestering capacity and adjusts the isolated nickel ions in the bath to a preferred condition, thus substantially improving the stability of the bath, the deposition rate and the uniformity of a film deposited. The second phosphorus deposition promoter may be added in an amount as required, and through an adjustment of the amount of addition of such promoter, an amorphous nickel-phosphorus alloy film 6*b* containing from 15 to 25 atom % of phosphorus can be deposited on the copper foil 6*a* in a relatively facilitated and stable manner.

An amorphous nickel-phosphorus alloy film 6*b* containing from 15 to 25 atom % of phosphorus exhibits excellent corrosion and abrasion resistances and non-magnetic properties. Accordingly, during an etching process which removes the synthetic mask 11 as well as the copper foil 6*a* in its regions located below the mask 11 after the application of the amorphous coating, an etching solution containing ferric chloride, for example, may be used, and the amorphous film 6*b* serves as an etch resist. Accordingly, the use of a separate resist film can be dispensed with.

In the preferred embodiment of the invention, the split electrodes 6 have the amorphous nickel-phosphorus alloy plated layer 6*b* containing from 15 to 25 atom % of phosphorus on its surface, and exhibit a high abrasion and corrosion resistance. The oxidation of the split electrodes 6 can be avoided up to relatively high temperature if the temperature of these electrodes rises due to heat radiation from the associated engine or by Joule heat caused by a contact resistance between the slider contacts and the split electrodes 6. Accordingly, a current of a relatively high magnitude can be used to flow through the split electrodes 6.

While the invention has been described above in connection with a particular embodiment thereof, it should be understood that a number of changes, modifications and substitutions will readily occur to those skilled in the art in the light of above teachings. By way of example, the copper foil 6*a* may be replaced by other metal layers which are used in a printed circuit arrangement. The slider may also comprise an amorphous plating. It is also possible to form the amorphous layer 6*b* by plasma chemical vapor deposition or sputtering process. Accordingly, the scope of the invention is not limited to the specific embodiment shown and described, but should be solely defined by the appended claims.

What is claimed is:

1. An electric contactor device comprising:

a first support member of an insulating material;

first electric contact means including a metal conductor secured to the first support member and an amorphous conductive layer of nickel-phosphorus alloy having a high phosphorus content of 21 to 25 atom percent bonded to the surface of the metal conductor by an electroless plating bath containing nickel ions, a reducing agent for said nickel ions, a pH buffer, a nickel ion sequestering agent, a small amount of a stress reducing agent and trisodium N-(2-hydroxyethyl)ethylenediamine-N,N',N'-triacetate as a first phosphorus deposition promoter in water;

a second support member of an insulating material and disposed for movement relative to the first support member; and second electric contact means secured to the second support member and disposed for engagement with the amorphous conductive layer.

2. An electric contactor device according to claim 1 in which the first support member is in the form of a plate and the metal conductor is in the form of a printed electrode.

3. An electric contactor device comprising:

a printed circuit board including a base plate of synthetic resin and printed electrodes formed on the surface thereof;

an amorphous conductive layer of nickel-phosphorus alloy having a high phosphorus content of 21 to 25 atom percent bonded to the surface of the printed electrodes by an electroless plating bath containing nickel ions, a reducing agent for said nickel ions, a pH buffer, a nickel ion sequestering agent, a small amount of a stress reducing agent and trisodium N-(2-hydroxyethyl)ethylenediamine-N,N',N'-triacetate as a first phosphorus deposition promoter in water;

a rotatable shaft;

a slider arm fixedly mounted on the rotatable shaft;

and a conductive slider member secured to the slider arm and disposed for engagement with the surface of the amorphous conductive layers.

4. An electric contactor device according to claim 3 in which the rotatable shaft extends across the thickness of the printed circuit board, the slider arm extends parallel to the printed circuit board and the conductive slider member is disposed in opposing relationship with the surface of the printed circuit board.

5. An electric contactor device comprising:

a base having an annular boss;

a rotatable shaft extending through a bore formed in the boss;

a printed circuit board fixedly mounted on the base so as to extend in a direction perpendicular to the rotatable shaft and carrying a plurality of split electrodes having their surface coated by an amorphous conductive layer and also having printed electrode leads which continue from the electrodes, said amorphous conductive layer being made of nickel-phosphorus alloy having a high phosphorus content of 21 to 25 atom percent by an electroless plating bath containing nickel ions, a reducing agent for said nickel ions, a pH buffer, a nickel ion sequestering agent, a small amount of a stress reducing agent and trisodium N-(2-hydroxyethyl)ethylenediamine-N,N',N'-triacetate as a first phosphorus deposition promoter in water;

a slider arm fixedly mounted on the rotatable shaft and disposed in opposing relationship with the printed circuit board;

a conductive slider member secured to the slider arm and disposed for engagement with the surface of the amorphous conductive layer;

a plurality of lead wires connected to the printed electrode leads;

and a casing member fixedly connected to the base so as to enclose a space in which the printed circuit board and the slider arm are received.

* * * * *